US007104293B2

(12) United States Patent
Lais et al.

(10) Patent No.: US 7,104,293 B2
(45) Date of Patent: Sep. 12, 2006

(54) COUPLING ELEMENT AND DOCKING DEVICE COMPRISING A COUPLING ELEMENT

(75) Inventors: Peter Lais, Auggen (DE); Joseph Sywalla, Zillisheim (FR); Joachim Stoye, Neuenburg-Grissheim (DE); Martin Koch, Neuenburg-Grissheim (DE)

(73) Assignee: GEA Buck Valve GmbH, (DE)

( * ) Notice: Subject to any disclaimer, the term of this patent is extended or adjusted under 35 U.S.C. 154(b) by 0 days.

(21) Appl. No.: 10/533,684

(22) PCT Filed: May 12, 2004

(86) PCT No.: PCT/DE2004/000985

§ 371 (c)(1),
(2), (4) Date: Nov. 3, 2005

(87) PCT Pub. No.: WO2004/103816

PCT Pub. Date: Dec. 2, 2004

(65) Prior Publication Data

US 2006/0151061 A1 Jul. 13, 2006

(30) Foreign Application Priority Data

May 15, 2003 (DE) ..... 103 21 814

(51) Int. Cl.
*B65B 1/04* (2006.01)

(52) U.S. Cl. ..... 141/302; 141/114; 141/319; 141/383; 24/30.5 R; 383/33

(58) Field of Classification Search ..... 141/10, 141/114, 313–319, 364, 383–386; 24/30.5 S, 24/30.5 W, 30.5 R, 462; 383/33–35, 68, 383/78

See application file for complete search history.

(56) References Cited

U.S. PATENT DOCUMENTS 4,975,591 A 12/1990 Hardt et al.

(Continued)

FOREIGN PATENT DOCUMENTS

| | | |
|---|---|---|
| DE | 43 29 276 | 3/1995 |
| DE | 196 24 189 | 1/1998 |
| DE | 695 04 581 | 4/1999 |

(Continued)

*Primary Examiner*—Steven O. Douglas
(74) *Attorney, Agent, or Firm*—Schiff Hardin LLP

(57) ABSTRACT

In a coupling element for decanting, filling, or emptying of containers, a first sealing strip a flank piece comprising elastic as a first mounting element at a first end defining a first inner space for retaining a first axis, and a second mounting element on a second opposite end defining a second inner space for retaining a second axis. A second sealing strip comprising elastic has a first mounting element on a first end which defines a first inner space for retaining the second axis, and a second mounting element on a second opposite end which defines the second inner space for retaining the first axis. Inner sides of the flank pieces of the first and second sealing strips are attachable to one another to form a seal. The first mounting element of the first strip in the second mounting element of the second strip are positioned adjacent one another to form a first articulated section, and the second mounting element of the first sealing strip and the first mounting element of the second sealing strip being adjacent to one another to form a second articulated section. The first articulated cap forming a pivot bearing is positioned at least partially over the first articulated section and a second articulated cap forming a pivot bearing as positioned at least partially over the second articulated section. The first axis is retained in the first inner space for pivotable mounting of the first articulated section and the second axis is retained in the second inner space for pivotable mounting of the second articulated section.

44 Claims, 9 Drawing Sheets

U.S. PATENT DOCUMENTS

| | | | | |
|---|---|---|---|---|
| 5,372,428 | A * | 12/1994 | Bruno et al. | 383/5 |
| 5,853,207 | A | 12/1998 | Saint Martin et al. | |
| 6,074,094 | A * | 6/2000 | Manolizi et al. | 383/5 |
| 6,954,969 | B1 * | 10/2005 | Sprehe | 24/399 |
| 2002/0133916 | A1 | 9/2002 | Folkmar | |
| 2003/0009858 | A1 | 1/2003 | Goldberg et al. | |

FOREIGN PATENT DOCUMENTS

| | | |
|---|---|---|
| DE | 201 17 669 | 4/2002 |
| FR | 811137 | 4/1937 |
| GB | 2 040 862 | 9/1980 |
| WO | WO 02/074631 | 9/2002 |
| WO | WO 03/037756 | 5/2003 |

* cited by examiner 13
114a
126
6
122
2
120
124
92a
128
18
12
17

COUPLING ELEMENT AND DOCKING DEVICE COMPRISING A COUPLING ELEMENT

BACKGROUND

The disclosed preferred embodiment relates to a coupling element and a docking device comprising a coupling element. The embodiment further relates to a holding device for the manipulation of the coupling elements and docking devices and a connection device comprising at least two coupling elements.

In many fields, in particular the manufacturing industry, there are often stringent requirements for the cleanliness of the primary products used, for which reason contamination caused by impurities at any point of the process, and not only during the production and isolation of the primary products, is to be avoided. However, it is often precisely when filling appropriate containers with the completed primary products, or when decanting the same for the purpose of further processing into intermediary or end products, that contact with the environment cannot be totally avoided. Thus the quality of the reprocessed products can be permanently affected, and if required, whole product batches are even discarded. On the other hand, particular care must be taken with toxic compounds to ensure that people and the environment do not come into contact with these substances, and this also makes it necessary to work very carefully, and isolated from the environment. It often suffices simply to work in clean room conditions in order to fulfill the requirements for the decanting of toxic substances into appropriate processing containers. In any case, the efforts taken not to contaminate valuable primary products, along with the aim not to contaminate the environment with toxic compounds goes hand in hand with a high level of expenditure on apparatus and safety regulations, which unavoidably has an effect upon production costs. These stringent requirements are, eg. regularly to be fulfilled by the food processing, the chemical or the pharmaceutical industries, for example when products in the form of bulk goods or fluids are to be transferred from a fixed first container into a transportable second container. Because many products, even in exceptionally small quantities, have a highly toxic effect upon the human organism, and other products react very sensitively to eg. the effect of air, effective coupling elements and docking devices were developed by the industry which should make it possible to fill or to empty a container in an isolated, or at least a dust-free state. For example, containers of this type are filled by means of a double cap technique which has proved to be very efficient, but also, due to the technical design and the materials used, very costly.

DE 695 04 581 T2 , for example, made known a sealed docking device of this type between containers isolated from the environment, which has an inflexible, annular flange with a door. The flange and the door are preferably produced from a hard plastic material. The containers, which can be made in the form of sacks, are preferably made from a soft synthetic material. A disadvantage of this docking device is the constructionally very high-cost processing of the flange with its cam mechanism serving as a locking mechanism, which incommensurately increases the production costs for a one-way object, and in addition, makes it non-user friendly because it is unwieldy.

Docking devices for contamination-free decanting are used in particular when handling radio-active materials, and regularly require a constructionally expensive locking arrangement, such as eg. that found in DE 39 05 362 A1. In addition, for each of these container types, a docking device adapted to the dimensions of the container is required.

DE 695 04 581 T2 presents a sealed docking device between two housings isolated from the environment, each respectively provided with a door. With this device, the outer sides of the doors can be attached to one another so as to form a seal, whereby the locking mechanism of the first door can also be controlled by a manipulation device on the second door. Following conveyance from the one housing into the other, the two-door unit is returned to its place in the respective retainers or mountings provided for this purpose, and the two housings can be separated from one another. In this way, the outer sides of the two doors remain free from impurities because they are isolated from one another during the transfer or conveyance. The docking device in accordance with DE 695 04 581 T2 is also constructionally expensive and can not readily be used on filling mechanisms isolated from the environment for structures with smaller dimensions.

Docking devices of a simpler design can, in accordance with DE 196 24 189 A1, also be formed from a first docking element which is funnel-shaped in design, and a second docking element, which is form-fitted onto on the funnel-shaped docking element, in particular forming a spherical contact surface. In order to guarantee it be gas proof, the contact surface has a rubber elastic surface. With the docking device in accordance with DE 196 24 189 A1, one can successfully decant media capable of flowing, however, it can not be guaranteed that when coupling or uncoupling the docking elements, that these media capable of flowing do not escape into the environment.

DE 43 29 276 A.1 proposes a dust sealed connection for transportable bulk containers, which are provided with a connection device. With this, the bulk goods container in docked state is engaged with the outlet from above via an elastic disc, and in closed state, sealed by a sealing cone. The outlet funnel of the bulk goods container here has a diameter which is greater than that of the hole in the rubber disc. A sealing cone located in the outlet funnel cuts off the stream of bulk material with its lower edge. By using a rubber disc with a deliberately under-sized outlet opening as a sealing element, it can, however, not be out of the question that, in any case with frequent use, damage will occur or the elasticity will be reduced, so that isolation from the environment of the outlet funnel is no longer guaranteed. Furthermore, special precautions must be taken in order to bring about sealing of the bulk goods container so as to isolate it from the environment by means of displacement of the sealing cone. The possibilities for using the dust-sealed connection in accordance with DE 43 299 276 A1 are therefore extremely limited.

DE 20 217 669 U1 describes a sealed docking device between two containers which are essentially isolated from the environment, whereby each container is essentially flexible, at least in sections, and can be attached so as to form a seal with a coupling element. The elastic coupling elements positioned alongside one another so as to form a seal are respectively provided with a slit which can be opened by elastic distortion of the coupling elements. Because the respective slits of the coupling elements which lie flush against one another lie exactly one above the other, the slits are opened by applying pressure onto opposite sides of the coupling elements, and the bulk material can be conveyed forward. In this way, in particular the handling in comparison with that using docking devices, as known by DE 69 504 581 T2, is simplified, and the production costs are reduced.

WO 03/037756 relates to a multi-walled change-over container comprising an inner and an outer shell. The space between the flexible inner container and the outer shell can be filled variably with compressed air by means of a compressed air supply so that the cross-section of the inner flexible container wall can be adjusted to reduce the fall velocity of the bulk material introduced by means of an upper inlet. In this way it can be carefully filled with bulk goods because account can be taken of the distance of the fall and the fall velocity of the bulk goods. Moreover, the effect of pressure upon the intermediary space between the inner and the outer shell can be used to remove the final bulk good remains quickly and efficiently when emptying the container. In addition, WO 03/037756 discloses a container which is provided with an elastic coupling element, comprising a slit opening, on its inlet and/or its outlet. This type of coupling element can, for example, have guide rails set on an edge which runs along its long sides, and is equipped with fixing elements on its opposite short edges for reciprocal fixing of the coupling elements which form a docking device. This type of coupling element is suitable for axial coupling to a second coupling element for the purpose of forming the previously described docking device.

GB 2 040 862 A discloses a packaging device for vacuum packaging and packaging which excludes air and humidity. As well as a suction line used to evacuate the container to be filled, holding and clamping members are also provided with which the opening edge of a flexible container is held and automatically opened and closed during filling. A one-piece holding device made from a rubber material can also be used here, which, in order to guarantee reliable opening and closing of the opening edge of the flexible container, is also equipped with metal struts. With the device introduced in GB 2 040 862 A, the filling cycles are shortened, contamination of the surrounding area is reduced or eliminated, and the monitoring during filling can be minimized.

An object is to provide a sealed docking device and coupling elements which form these docking devices, as well as to provide methods for filling containers with bulk goods or fluids in a way that is isolated from the environment, so that disadvantages of the prior art are overcome, and in particular so that handling is simplified and production costs are reduced.

In a coupling element for decanting, filling, or emptying of containers, a first sealing strip a flank piece comprising elastic as a first mounting element at a first end defining a first inner space for retaining a first axis, and a second mounting element on a second opposite end defining a second inner space for retaining a second axis. A second sealing strip comprising elastic has a first mounting element on a first end which defines a first inner space for retaining the second axis, and a second mounting element on a second opposite end which defines the second inner space for retaining the first axis. Inner sides of the flank pieces of the first and second sealing strips are attachable to one another to form a seal. The first mounting element of the first strip in the second mounting element of the second strip are positioned adjacent one another to form a first articulated section, and the second mounting element of the first sealing strip and the first mounting element of the second sealing strip being adjacent to one another to form a second articulated section. The first articulated cap forming a pivot bearing is positioned at least partially over the first articulated section and a second articulated cap forming a pivot bearing as positioned at least partially over the second articulated section. The first axis is retained in the first inner space for pivotable mounting of the first articulated section and the second axis is retained in the second inner space for pivotable mounting of the second articulated section.

DESCRIPTION OF THE PREFERRED EMBODIMENTS

Figure 1A:
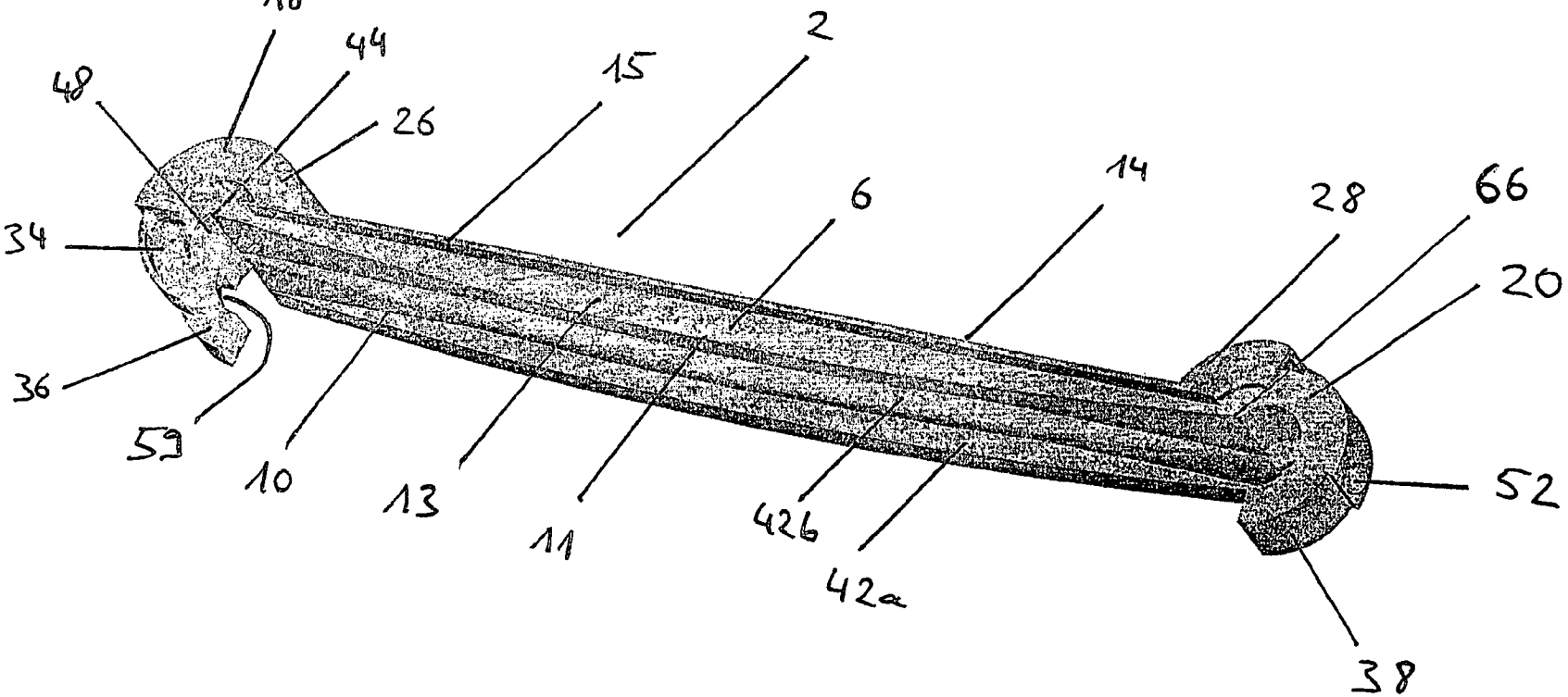
FIG. 1*a*) shows a perspective view of a sealing strip of a coupling element in accordance with the preferred embodiment.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A coupling element is provided for the decanting, filling and/or emptying of containers, isolated from the environment, comprising at least a first sealing strip including a flank piece which is elastic at least in sections, with an inner side, an outer side, an upper side and/or edge, and/or a lower side and/or edge, at least a first mounting element on the first end of the flank piece, in particular with a rounded, in particular radial, outer circumference or outer circumference section and/or at least a first inner space for retaining an articulated axis, and at least a second mounting element on the second end of the flank piece which lies opposite the first end, in particular with a rounded, in particular radial, outer circumference or outer circumference section and/or at least a second inner space for retaining an articulated axis;

at least a second sealing strip including a flank piece which is elastic, at least in sections, with an inner side, an outer side, an upper side and/or edge, and/or a lower side and/or edge, at least a first mounting element on the first end of the flank section, in particular with a rounded, in particular radial, outer circumference or outer circumference section, and/or at least an inner space for retaining an articulated axis, and at least a second mounting element on the second end of the flank piece which lies opposite the first end, in particular with a rounded, in particular radial, outer circumference or outer circumference section and/or at least an inner space for retaining an articulated axis;

whereby the inner sides of the flank pieces of the first and second sealing strips can be attached to one another so as to form a seal, at least in sections, whereby the first mounting element of the first sealing strip with the second mounting element of the second sealing strip, and the second mounting element of the first sealing strip and the first mounting element of the second sealing strip can respectively be positioned adjacent to one another with at least, in sections, reciprocal positioning of the inner sides of the flank pieces of the first and second sealing strips, so as to form first and second, in particular common outer surface areas, in particular cylinder surface areas;

at least a first articulated cap which, by forming a pivot bearing, can be positioned, at least partially, over and/or around a first articulated section, in particular the first and the second mounting elements, adjacent to one another, of the first and second sealing strips, and/or at least a second articulated cap, which by forming a pivot bearing, can be positioned at least partially over and/or around a second articulated section, in particular the second and first mounting elements, adjacent to one another, of the first or second sealing strip; and/or at least a first articulated axis for retaining in the first inner space for the pivotal mounting of the first articulated section, in particular of the first and second mounting elements of the first and second sealing strips, and/or at least a second articulated axis for retaining in the second inner space for the pivotal mounting of the second articulated section, in particular of the second and first mounting elements of the first and second sealing strips.

By pressing together the first and the second articulated sections and/or by the pulling apart of the first and the second sealing strips, the coupling element/s in accordance with the preferred embodiment is/are opened, whereby the spring elastic flank pieces or the spring elastic sections of the same guarantee a reversible, reliable seal.

In this way, in accordance with the preferred embodiment, the first and/or second mounting element/s of the first and/or second sealing strip/s can reproduce, at least partially, the shape of an annulus, and in particular form bridging arms.

The first and second mounting elements are preferably designed in such a way that they form an articulated section which is held by means of a common axis and/or by means of a common articulated cap in such a way that a hinge-type, controlled movement of the flank pieces connected to the mounting elements is made possible. A rounded or circular outer and/or inner surface of the mounting elements generally makes it possible to provide articulated control in a simple manner. Of course, adjacent mounting elements and/or the outer and/or the inner surfaces of the articulated sections can be provided with a lubricant and/or grease.

In an embodiment, it is proposed that the first and/or second mounting element/s of the first and/or second sealing strip/s is/are attached or attachable to the outer side of the first and/or second end/s of the flank piece of the first and/or second sealing strip/s. By attaching the mounting elements onto the outer side of the sealing strip, as much space for movement as possible is allowed over the whole length of the flank piece. From this embodiment, eg. those coupling elements are included with which the mounting element/s are an integral part of the first and/or second sealing strip/s, as well as those with which the mounting element/s are in the form of separate components which can be connected reversibly to the sealing strip or the bars or flanks of the sealing strip. A mounting element, for example, can be coupled by means of a catch connection, a clip/groove connection or any other reversible, releasable force fit or form fit connection to the sealing strip. This makes handling of the coupling elements in accordance with the preferred embodiment very simple, and also makes it possible to be able to hold containers, sealed, with the help of the sealing strips, without having to use additional mounting elements. For this, for example, one cam also resort to a separate covering track which can be pulled over the first and second sealing strips positioned over one another, eg. with the help of a clip/groove connection. The number of constructionally, expensive and therefore cost-intensive mounting elements required for filling or decanting can be greatly reduced in this way, without having to accept any limitations when filling with or decanting bulk goods.

Thus, in accordance with the preferred embodiment, the first and/or second, in particular annular, mounting element/s may not extend to the inner side of the flank piece of the first or second sealing strip, and in particular, it/they may have a central angle in the range of from 90° to 240°. If the mounting elements do not circumscribe a fully circular path, but rather leave an opening on the inner side of the flank pieces, handling when joining together the sealing strips of coupling elements and docking devices, as well as, in particular, the attachment of bag edges to the sealing strips, is made easier.

A further embodiment is characterized in that the first and/or second articulated cap/s has/have inner dimensions which essentially correspond to the outer dimensions of the adjacent first and/or second mounting element/s, so that with inner sides of the flank pieces of the first and second sealing strips which are positioned together, the first articulated cap at least partially encloses, flush, the first and second mounting elements of the first and second sealing strips, and the second articulated cap at least partially encloses, flush, the second and first mounting elements of the first or second sealing strip, forming a pivot bearing. The forces to be used for bending the elastic flank pieces away from one another can, for example, be applied to the sealing strips by using an articulated cap. This articulated cap holds the first and second mounting elements which form the articulated section, even when opening and closing the flank pieces in their pre-specified, adjacent position.

In another embodiment it is proposed that the first and/or second articulated cap/s comprise/s an articulated cap cover with an articulated axis, in particular in the form of a hollow cylinder segment, which can be introduced into the first inner space formed from the first and second mounting elements of the first and second sealing strips, and the second inner space formed from the second and first mounting elements of the first and second sealing strips. In addition, for the fixing or guiding of the mounting elements by means of an articulated cap, in an especially preferred embodiment, an articulated or rotating axis can also be introduced into these first and second mounting elements or the first and second inner spaces.

Preferred coupling elements are also characterized in that the first end, in particular of the inner side, of the flank piece of the first sealing element and/or the second end, in particular of the inner side, of the flank piece of the second sealing element, extend/s into the first inner space, in particular approximately as far as the central point: of the inner space, and/or that the second end, in particular that of the inner side, of the flank piece of the first sealing strip and the first end, in particular of the inner side, of the flank piece of the second sealing strip extends into the second inner space, in particular approximately as far as the central point of the inner space. It has proved to be especially advantageous to end the flank pieces approximately at the central point of the first and second inner spaces formed by the first and second mounting elements. In this way, on the one hand, the mechanical strain placed upon the components of the coupling element is minimized. On the other hand, the bag edges attached to the flank pieces are handled very gently, and do not experience any distortion when the coupling element is opened and closed.

It has also proven to be advantageous if the first mounting element of the first and/or second sealing strip/s comprises an annular section, at least in sections, and that the second mounting element of the first and/or second sealing strip/s comprises at least two annular sections spaced apart from one another, whereby the annular section of the first mounting element can be fitted, in particular flush, between two annular sections of the second mounting element, spaced apart from one another, forming a first articulated section, and/or whereby the annular section of the second mounting element can be fitted, in particular flush, between two annular sections of the first mounting element, spaced apart from one another, forming a second articulated section, respectively forming an inner space for retaining at least one articulated axis. Because the first and second mounting elements of the first and second sealing strips are designed in such a way that they can be fitted into one another, flush, the quality of the guiding and the fixing during opening and closing of the coupling element is increased once again.

With this, it can also be proposed in accordance with the preferred embodiment, that the first and second mounting elements of the first and second sealing strips form, at least in sections, an essentially uniform cylindrical or spherical outer surface.

In accordance with another aspect, preferred coupling elements are characterized in that the inner side of the flank piece of the first sealing strip and/or the inner side of the flank piece of the second sealing strip is/are curved, at least in its initial state, in particular in the form of a circle segment. Consequently, the inner sides seal an opening slit when positioned reciprocally. If a coupling element is created in accordance with the preferred embodiment from two flank pieces, which are respectively curved on their inner side, this first of all means that, with fixed mounting elements or articulated sections, the inner sides of these flank pieces which are positioned together essentially form a straight sealing line. In such cases, the curving of the inner sides in an initial state with this type of coupling element brings about a pre-tensioning, and subsequently an even more reliable seal. Furthermore, the use of flank pieces curved on the inner side in a coupling element in accordance with the preferred embodiment means that the outer sides of these flank pieces in this type of coupling, element often have outer curving. This outer curving is appropriate, so as to control or facilitate uncapping or opening of the flank sections which are positioned together.

Accordingly, it is proposed in accordance with the preferred embodiment that with, in particular flush, positioning of the inner sides of the flank pieces of the first and second sealing strips, at least one outer side of a flank piece has outer curving.

Also particularly preferred are coupling elements whereby the inner side of at least one flank piece is profiled. By profiling the inner side of the flank pieces, not only can the sealing of the coupling elements once again be improved, but also the risk of residual contamination, eg. as a result of bulk material residue remaining in the, area of the coupling element, is considerably reduced.

In accordance with a preferred embodiment, preferred coupling elements have at least one protuberant bar and/or at least one recessed groove on the inner side of the flank piece of the first and/or second sealing strip/s, which e),.: tend/s in particular from the first to the opposite second end of the flank piece, preferably parallel to the longitudinal axis of the flank piece.

In this way, there is at least one protuberant bar in the area of at least one longitudinal edge or in the form of a longitudinal edge, and/or there is at least one, in particular central, recessed groove between two longitudinal edges and/or protuberant bars spaced apart from one another.

In this way, also in accordance with the preferred embodiment, the protuberant bar in the longitudinal section is essentially in the form of a circular section, in particular with a maximum protuberance approximately in the center of the flank piece.

Moreover, it is especially preferably considered that at least one inner wall, and preferably both inner walls of the flank pieces of the first and second sealing strips, has/have at least one, in particular central, protuberant bar and at least one recessed groove between the protuberant bar and the upper longitudinal edge, and at least one recessed groove between the protuberant bar and the lower longitudinal edge of the inner wall.

Especially preferred here are those coupling elements whereby the protuberant bar emerges more strongly, at least in sections, from the inner wall than the lower and/or upper longitudinal edges of the same.

It is possible, for example, in particular only to design the longitudinal edges and the protuberant bars on the inner walling of the flank pieces to be elastic, or only those areas which are significant for reliable sealing when the inner sides of the flank pieces are positioned reciprocally. Preferably, the flexible containers or tubes are not attached to these elastic areas by means of an adhesive, but only in areas which are non-essential for reliable sealing of the flank pieces. In this way it is prevented that the long-term elasticity of the areas specified, used for the reliable sealing of the inner walling by means of glue or adhesives, is effected.

Accordingly, a particularly preferred coupling element has a flexible container or a flexible tube which can be attached or is located, in particular along the rims or longitudinal edges, on the inner side, outer side, upper edge and/or lower edge of the flank pieces of the first and/or second sealing strip/s, and in particular along the whole length of the flank pieces.

A preferred embodiment is characterized in that the container or tube covers the whole inner side of the flank pieces of the first and/or second sealing strip/s, in particular the edge of the container or of the tube approximately corresponds to the edge of the inner side of the flank pieces of the first and/or second sealing strip/s and/or extends over this.

The container or the tube can be stuck or welded eg. by their whole surface or partially with the flank piece or the inner side of the same. In a preferred embodiment, the tube or the flexible container is already integrated, at least to one component of the coupling element, at the time of the injection molding of the flank piece or the sealing strip. This means that an additional procedural step is not necessary, and a particularly solid and well-sealed join is produced. Moreover, the hardening phenomena, which can occur when using glues as a result of the interaction with eg. a flexible plastic material of the flank piece, can be avoided. A further development here also proposes that the tube or the container is incorporated into or attached to the first flank piece or to the first sealing strip as well as to the second flank piece or the second sealing strip of a coupling element while these components are being injection molded, either in one step, or in a sequence of procedural steps.

Also in accordance with the preferred embodiment, the first and/or second sealing strip/s on the longitudinal upper and/or lower side/s, in particular respectively comprising the section between the inner and the outer side of the flank piece of the first and/or second sealing strip/s, can have at least one coupling device, in particular in the form of a groove and/or clip.

Appropriately here, the first and/or second sealing strip/s or the flank sections of the same has/have a groove or a clip on the longitudinal upper side, and a clip or a groove on the longitudinal lower side.

It has proven to be advantageous to provide coupling devices on the upper and lower sides of the coupling elements in accordance with the preferred embodiment because this means that there are docking devices respectively formed from two coupling elements which are characterized by particularly effective isolation from the environment. Of course, a docking device can also already be obtained with two coupling elements in accordance with the preferred embodiment which can be joined together flush, with which the bulk goods can be decanted, isolated from the environment, in particular if the edge of the container or of the tube approximately corresponds with the edge of the inner side of the flank pieces of the first and/or second sealing strip/s and/or extends over the same.

Preferred embodiments of the coupling elements in accordance with the preferred embodiment are also characterized in that the first and/or second sealing strip/s, in particular the upper and/or lower side of the flank pieces of the first and/or second sealing strip/s is/are provided, at least in sections, with an adhesive, or at least a layer of glue. The advantage of applying an adhesive or sticking surface, in particular on the side of the sealing strip which has a. groove (passive side) is that, during the filling or decanting process, non-transferred particles or non-completely transferred bulk material or fluid remain stuck to the coupling element, and do not escape into the environment. Appropriately, one can resort to removable adhesive strips which can be removed after use and replaced by a new adhesive strip.

In accordance with another embodiment, it is proposed that the first and the second sealing strips essentially correspond to one another with regard to their shape and/or size. A particular advantage of the coupling elements in accordance with the invention is that they can be formed from two essentially identical sealing; strips. For this, one of the sealing strips only respectively has be rotated around 180° C. so that it can be brought into position with a further sealing strip to form a coupling element. This reduces production costs, simplifies assembly, and finally also reduces stoppages when filling with and decanting bulk goods.

In another preferred embodiment, the flank piece of the first and/or second sealing strip/s by or on the inner side, in particular extending over the whole length of the inner side, has at least one elastomer or thermoplastic elastomer segment. The flank piece or the sealing strip can be produced from two or more different materials, whereby the inner side of the flank piece preferably comprises, because of the desire to create a better seal, an elastomer or thermoplastic-elastomer material, whereas the outer side can eg. be produced from a thermoplast. These components can be produced eg. in a single process step by means of two-component injection molding.

In accordance with another aspect of the preferred embodiment, it can also be possible for the articulated cap to comprise a first and a second articulated cap half.

In accordance with the preferred embodiment, the first and/or second articulated cap half here can have a lockable opening in the rounded outer surface for retaining a locking pin of a mounting element and/or at least one locking bolt on an inner side of a cover for retaining a mounting element in a recess on the lower or upper side.

Preferred coupling elements here are designed in such a way that the first and/or second articulated cap/s has/have a pre-specified open section which determines the opening angle of the first and second sealing strips in the area of the first and second articulated sections. By means of the maximum deflection defined by the opening angle in the articulated section, it is possible, in a simple manner, to set the maximum size of the opening of the coupling element, and so also to set a pre-specified fall velocity for the bulk material.

In accordance with another aspect, especially preferred coupling elements are characterized in that the mounting elements, in sections at least, and in particular along the rounded outer surfaces, contain thermoplastic polymers, in particular polyoxyalkylene, preferably polyoxymethylene (POM), and/or polyketone, preferably alternating carbon monoxide/ethylene copolymers. In particular, appropriate materials are characterized by a low level of abrasion and very good slide friction qualities.

Moreover, coupling devices in accordance with the preferred embodiment can have at least one separate and/or integrated locking unit for, in particular temporary, fixing of the position of the first and/or second sealing strip/s or the flank pieces of the same, and/or at least one separate or integrated cover unit for, at least in sections, and in particular isolated from the environment, covering of at least one side or surface of the coupling element provided for docking. Of course, the locking unit and the cover unit can be made as one component. Appropriate locking and/or cover units can also be designed as a transportation aid, eg. as a transportation clip, and guarantee non-problematic transportation or non-problematic storage of eg. containers and bags, without any concerns that the content may contaminate the environment during transportation or storage. With the locking and cover units, appropriate means are available for securing a coupling element before and after use against unintentional opening or closing, and for protecting the docking surfaces from contamination. The sealing strips and flank pieces appropriately have at least one locking element, eg. a locking groove, on their respective outer sides, into which the locking and cover units can by introduced by means of corresponding devices, eg. tracks.

The problem which forms the basis of the preferred embodiment is also solved by a docking device for decanting, filling with and/or emptying of bulk goods and/or fluids, isolated from the environment, comprising at least two coupling elements in accordance with the preferred embodiment, which can be attached and/or docked to one another, in particular flush. The lower side of the first coupling element, in particular the lower side and/or the lower edge of the flank piece of the first and second sealing strips regularly come into contact here with the upper side of the second coupling element, in particular the upper side and/or edge of the flank pieces of the first and second sealing strips. The coupling elements used for the docking device in accordance with the preferred embodiment preferably correspond to one another with regard to shape and size in such a way that when the first and second articulated sections positioned opposite one another and/or the first and second coupling elements have pressure applied to them, the flank pieces of the first and second coupling elements bend apart from one another, in particular uniformly, ie. they open and close at the same time. The movement of flank pieces of the first and second coupling elements which are positioned together can be particularly effectively guaranteed, eg. by means of coupling devices, eg. grooves and clips, which engage with one another. In such cases, a clip, for example, which corresponds to a groove with respect to shape and size, lies on the lower side or edge of the flank pieces of the first and second sealing strips of the first coupling element respectively, said clip being provided on the upper side or edge of the flank pieces of the first and second sealing strips of the second coupling element. In this way it is possible to hold a bulk goods container closed, isolated from the environment, by means of a first coupling element attached to this until it has been decanted, and to couple it, also totally isolated from the environment, to a second coupling element, forming a docking device in accordance with the preferred embodiment. In addition, the decanting process can take place totally isolated from the environment because the first and second coupling elements of the docking device are coupled to one another as the opening and closing movements take place.

In another embodiment of the docking device in accordance with the preferred embodiment, it is proposed that at least one coupling element, in particular isolated from the environment, is attachable or attached to a flexible container, in particular around the edge of the opening.

In this way, it is possible in accordance with the preferred embodiment, for at least one coupling element to be attachable or attached to a flexible tubular molded section, in particular around the edge, in particular isolated from the environment.

The problem which forms the basis of the preferred embodiment is also solved by a holding device for the manipulation of coupling elements in accordance with the preferred embodiment and/or docking devices in accordance with the preferred embodiment, comprising a first retainer and/or locking unit for, in particular flush, retaining and/or locking of the first articulated section and/or of the first articulated cap of a coupling element or of a docking device; a second retaining; and/or locking device for, in particular flush, retaining and/or locking of the second articulated section positioned opposite the first articulated section, and/or of the second articulated cap of the coupling element or of the docking device; and a positioning mechanism which is set up in such a way in order to move the first retaining and/or locking unit and the second retaining and/or locking unit towards and away from one another when opening and closing the coupling element or docking device.

The holding device in accordance with the preferred embodiment preferably has at least one articulated axis for retaining a first and/or second mounting element of the first and/or second sealing strip/s, in particular of the first and/or second articulated sections.

In addition, the first and/or second retaining and/or locking unit/s here can have a lower and/or upper, in particular pivotal or movable, locating mechanism.

Moreover, the preferred holding devices are characterized in that the distance moved by the first and second retaining unit towards or away from one another is limited.

The holding device can be manipulated manually or semi- or fully automatically and used for unlocking, locking, opening and closing of a coupling element or a docking device. The positioning mechanism can eg. make use of pivotal articulation or of an actuating drive, with or without pivotal articulation.

In accordance with an advantageous embodiment, the holding device is characterized by at least one positioning mechanism which is driven pneumatically, hydraulically or by an electric motor, and which in particular is semi- or fully automatic. An eg. pneumatically driven holding device once again increases reliability for filling with, decanting or emptying of bulk goods. In addition, with this type of device, it is possible to constantly provide optimal opening and closing of the docking devices in accordance with the invention, independent of the size and/or elastic properties of the same.

In an advantageous embodiment, the holding device in accordance with the preferred embodiment also has at least one suction device which can be added or is positioned to work in conjunction with the first and/or second holding device/s and/or the first and/or second articulated cap/s and/or first and/or second articulated section/s of the first and/or section coupling element/s. By combining the holding device with a suction device, eg. after completion of the decanting and closing of the docking device, and before the first and second coupling; elements of the docking device are uncoupled, bulk material residue which remains in the area of the articulated sections, can be sucked out. In this way, the risk of residual contamination when uncoupling the docking device is once again reduced.

Finally, the problem which forms the basis of the preferred embodiment is solved by a connecting device for filling with or decanting of bulk goods or fluids, isolated from the environment, comprising an essentially tubular structure with at least a first and a second opening, whereby at least the areas along the edge of the first and second openings are flexible in form, and a first coupling element in accordance with the preferred embodiment which, in particular isolated from the environment, is attachable or attached to the first opening of the tubular structure, and a second coupling element in accordance with the preferred embodiment, which, in particular isolated from the environment, is attachable or attached to the second opening of the tubular structure.

This preferred embodiment is thus based upon the realization that, by means of the embodiment of a coupling element or a docking device, in accordance with the preferred embodiment, for the filling and emptying of, at least in sections, essentially flexible containers, effective, contamination-free filling with and decanting of bulk goods and/or fluids is guaranteed. In addition, the coupling elements and docking devices in accordance with the invention have an effective constructional design with a very small number of individual components, and offer a high degree of reliability and safety, because eg. defects arising from technical faults or arising from manifestations of wear and tear can be more or less ruled out, even when operational over long periods of time. Moreover, the coupling elements and docking devices in accordance with the preferred embodiment can be produced at low cost. In a very advantageous embodiment, a coupling element can even comprise two identical first and second sealing strips. In the same way, it is now possible to provide a docking device comprising four identical sealing strips, and this, once again, considerably facilitates production and handling. Any lost individual parts can in this way be replaced without any problem. Furthermore, the whole cross-section of the outlet opening of a coupling element or a docking device in accordance with the preferred embodiment can be used, whereas in accordance with the established double cap technique, the double cap inserts reduce the cross-section.

The docking devices and coupling elements in accordance with the preferred embodiment are appropriate for the filling of flexible containers directly from filling or production units, in particular isolated from the environment. These docking devices and coupling elements can also be used reliably and with no problems in order to fill or empty eg. sacks, production units, formulation units, extruders and injection molding and blow molding machines, without any contamination. In particular, when it is applicable to ensure that only those materials intended for the production are used, eg. when introducing e-duct (starting) material for the synthesis of pharmaceutical products or of pharmaceutical intermediary or end products, as well as formulated products, the docking device in accordance with the preferred embodiment or the coupling elements in accordance with. The preferred embodiment have proven to be extremely advantageous. Very pure synthetics, for example, can also be obtained in a very reliable manner, in that granulate is filled by means of the docking unit in accordance with the invention directly into a synthetic processing unit, eg. an extruder, whereby in a preferred embodiment, the coupling elements, docking devices and/or containers can be produced from the same material a the substance to be decanted.

With the docking device in accordance with the preferred embodiment, filling and emptying stations can be designed essentially more. simply and more cheaply for production units, without having to accept any losses with regard to contamination-free work. The coupling elements and docking devices in accordance with the preferred embodiment also make certain that the environment is not polluted by bulk material residue, and also that the bulk goods to be transferred are not contaminated by materials and particles from the environment. It was also surprising to find in connection with this, that by adapting material and coating material applied to the bulk goods material to be decanted, used for the docking devices and coupling elements in accordance with the preferred embodiment, residue contamination can be fully avoided. In these cases, even the friction which occurs when decanting with the coupling elements does not lead to contamination of the bulk goods, eg. in the case of polymer granulate. The coupling elements and docking devices in accordance with the invention thus contribute to protection of the environment and of the product.

FIG. 1 shows a first sealing strip 2 of a coupling element 1 in accordance with the preferred embodiment. The first sealing strip 2 has a long flank piece 6 and a first mounting element 18 on the first end of the flank piece 6, and a second mounting element 20 on the second end of the flank piece 6 which is positioned opposite the first end. The flank piece 6 comprises an outer wall 14 and an inner wall 10, whereby the inner wall 10 is slightly curved in its initial state, with a maximum protuberance 11 approximately in the center of the flank piece which steadily flattens out towards both sides, ie. towards the first and the second end. The flank piece 6 further comprises an upper side 13 with an upper edge 15 and opposite, a lower side with at least one lower edge (not shown). In the initial state, no external mechanical forces act upon the flank piece. In accordance with the embodiment shown in FIG. 1, two additional protuberant bars 42*a*, 42*b* can be attached to the advantageous design illustrated of the inner wall 10 of the flank piece 6 along the longitudinal alignment of the flank piece 6 or be an integral component of the same. These protuberant bars 42*a*, 42*b* are a component part of a particularly preferred embodiment of a coupling element in accordance with the preferred embodiment, the function of which will be described below. Of course, the coupling element 1 in accordance with the preferred embodiment also includes designs, whereby protuberant bars 42*a* and 42*b* are not included. Furthermore, the flank piece 6 can be sub-divided into a outer wall section 14 made from an eg. only moderately elastic, for example thermoplastic material, and an inner wall section 10 made from a more elastic material. These types of material combination can be obtained, for example, by means of co-extrusion or multi-component injection molding in one process step. In the area of the first end 44 of the flank piece 6, there is a first mounting element 18 which is attached by its attachment piece 26 onto the outer side 14 of the flank piece 6. Correspondingly, the second mounting element 20 is provided on the second end 66 of the flank piece 6. In the sectional view, the first and second mounting elements 18 and 20 essentially form an annulus, but left open, ie. the bridging pieces or bridging arms are not closed to form a full circle. In accordance with FIG. 1, the first mounting element 18 comprises two bridging arms 34 and 36, spaced apart from one another. The distance between these bridging arms is chosen such that a bridging arm 38' of a second sealing strip 4 can be accommodated within this (not shown). In addition, in a preferred embodiment, the second bridging arm 36 has a recess 59 on its lower side, the function of which is described below. The bridging arms 34 and 36 and the first mounting element 18 enclose, at least partially, a space 48 into which the first end 44 of the flank piece 6 extends. Preferably, this first end 44 is positioned in approximately the central point of the aforementioned circle formed by the annular bridging arms 34 and 36. Preferably, both the outer as well as the inner surfaces of the bridging arms 34 and 36 are in the form of cylinder segments. The second mounting element 20 comprises an attachment piece 28 which is continued by the bridging arm 38. The second end 66 of the flank piece 6 is also preferably placed in approximately the central point of the circle formed by the bridging arm 38. On the outer surface of the bridging arm 38 there is a locking pin 52, the function of which will be discussed below.

Figure 1B:
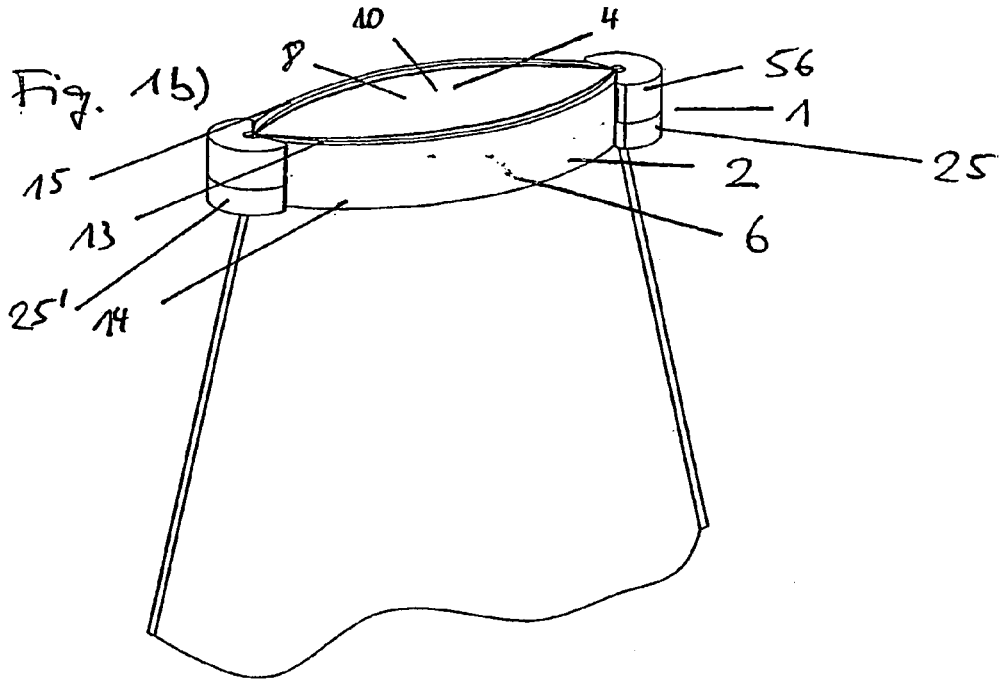
FIG. 1*b*) shows a perspective view of a coupling element in accordance with the preferred embodiment.

The coupling element 1 in accordance with the preferred embodiment can, as shown in FIG. 1*b*), be obtained in that a first sealing strip 2 and a second sealing strip 4, which can be essentially identical to the sealing strip 2, are positioned together along the inner sides of their flank pieces 6 and 8. In this way, the first end 44 of the flank piece 6 of the first sealing strip 2 is attached to the second end of the flank piece of the second sealing strip 4, and the second end of the flank piece of the first sealing strip 2 to the first end of the flank piece of the second sealing strip 4, and the bridging arm 38 of the first sealing strip 2 engages into a first mounting element 22 of the second sealing strip 4, containing bridging arms 34' and 36', which are spaced apart from one another, and a bridging arm 38' of the second sealing strip 4 engages into the first mounting element 18, containing the bridging arms 34 and 36, forming articulated sections 25 and 25'. The inner walls 10 and 12 of the flank pieces 6 and 8 of the first and second sealing strips 2 and 4 are brought into position here by means of their protuberant bars 42*a*, 42*b* and 42'*a* and 42'*b*. If the first and second mounting elements 18, 20, 22, 24 of the first and second sealing strips 2, 4, which are engaged together, are respectively arranged so as to be flush, and so as to form first and second articulated sections 25, 25' over one another, due to the elastic properties of the flank pieces 6 and 8 and the rounded form of the inner walls 10 and 12, this will lead to a slightly rounded outer curving of the outer walls 14, 16 of the flank pieces 6 and 8 in the assembled coupling element 1.

Figure 2:
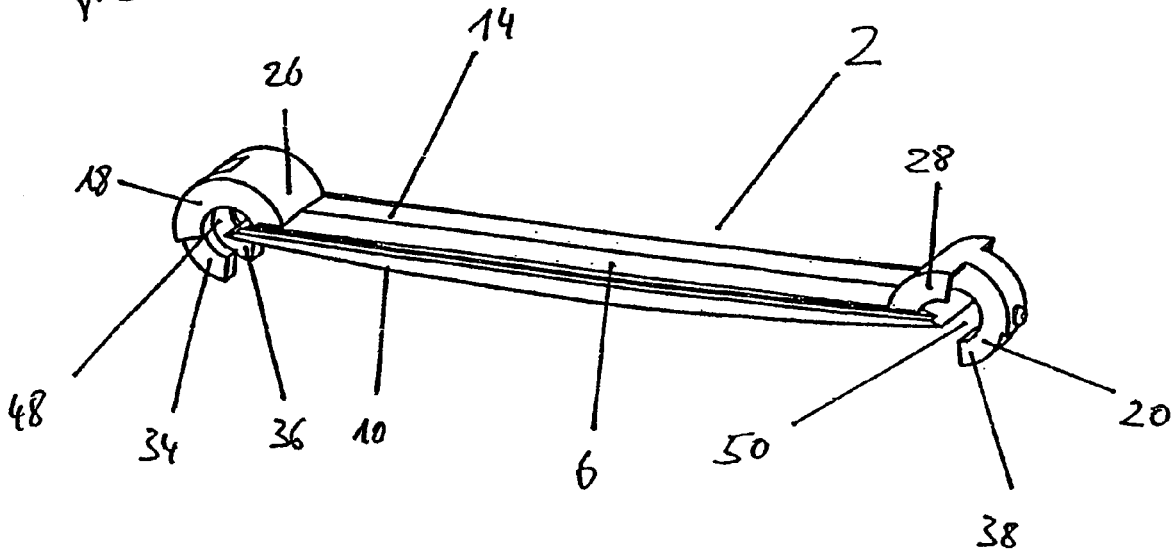
FIG. 2 shows a representation of the sealing strip in accordance with FIG. 1 in a perspective side view.

In FIG. 2, a first sealing strip 2 of a coupling element 1 in accordance with the preferred embodiment is shown once again in a schematic side view, seen from above. As can be seen from this illustration, the attachment pieces 26 and 28 of the first and second mounting elements 18, 20 respectively begin at opposite ends of the outer wall 14 of the flank piece 6. Here, at least the inner wall section 10 continues into the center of the cavities 48 and 50 partially enclosed by the bridging arms 34, 36 and 38. As shown by FIG. 2, the flank piece 6 is produced from two different segments, ie. an outer wall section 14 and an inner wall section 10, directly attached to this, which has a slight curve. Seen from the side, the bridging arms 34, 36, 38 approximately cover an annulus of 250 to 300°. The bridging arms can basically be extended so far along the inner wall of the sealing strip, that is it always still possible to attach a second sealing strip, as described above, to the first sealing strip, so as to form a coupling element in accordance with the preferred embodiment.

Figure 3:
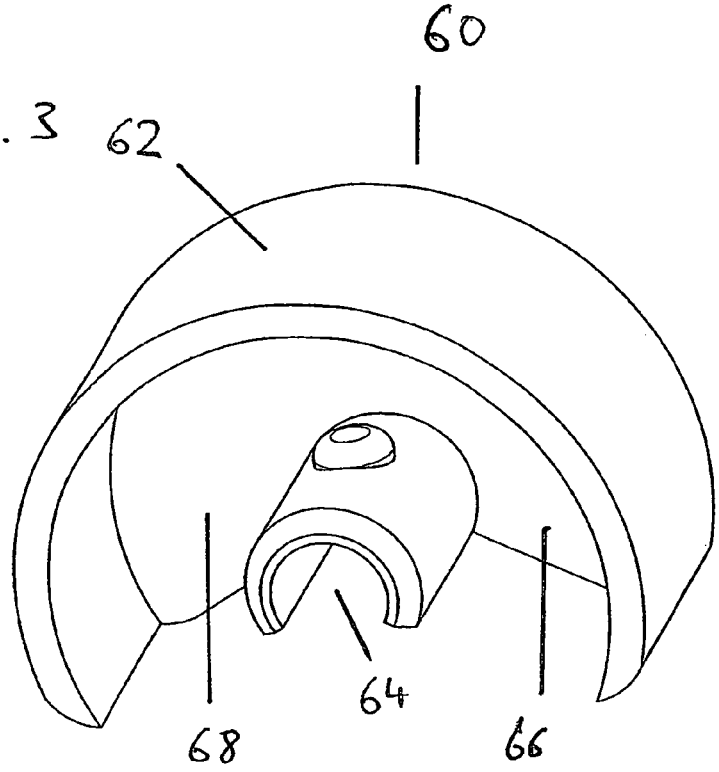
FIG. 3 shows a perspective overhead view onto a first articulated cap half of a coupling element in accordance with the preferred embodiment.

FIG. 3 illustrates a first articulated cap half 60 with an outer wall 62, a truncated inner hollow cylinder 64, and an articulated cap cover 66, which together circumscribe at least part of a retainer space 68 for the first and second mounting elements. The articulated cap half 60 can be attached onto the first and/or second mounting elements of the first and second sealing strips 2 and 4 which are attached to one another, so as to create a rotating piece or an axis of rotation. The truncated inner cylinder 64 is designed in such a way that, if so required, the first or second end of the flank piece can also be accommodated in the hollow space 48 and 50. The truncated inner cylinder 64 preferably has dimensions which mean that it can be introduced, in particular flush, into the spaces 40 and 50, formed by the mounting elements, and partially enclosed. In the same way, the dimensions and shape of the inner side of the outer wall 62 correspond, in particular flush, to the outer contours of the first and second mounting elements of the first and second sealing strips.

Figure 4:
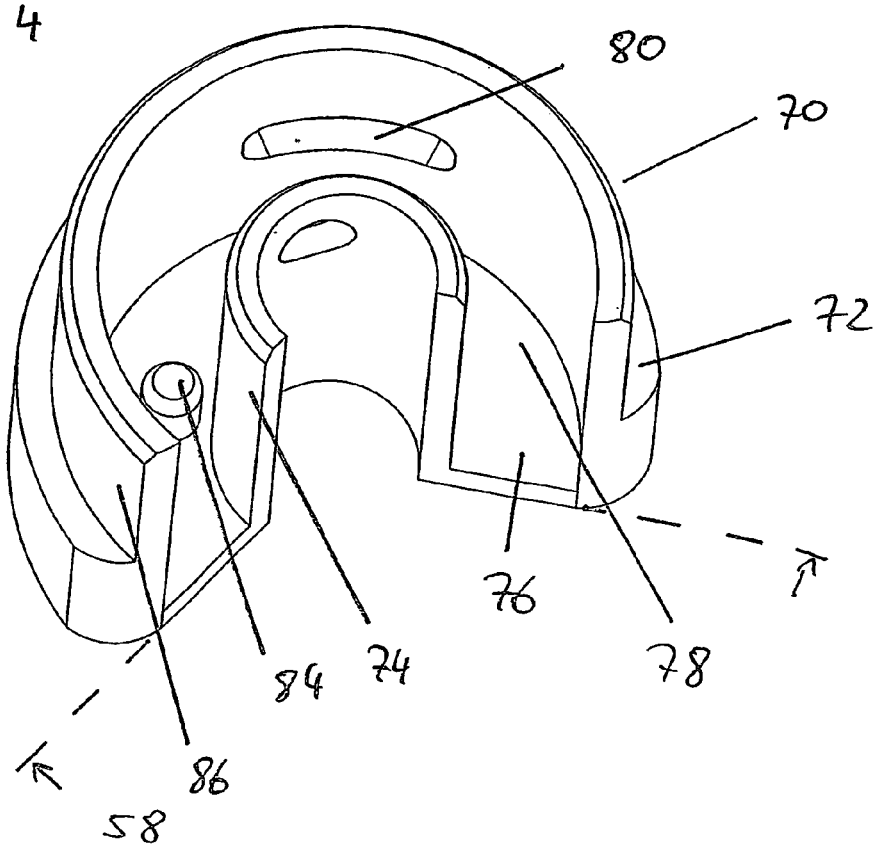
FIG. 4 shows a perspective view of a second articulated cap half of a coupling element in accordance with the preferred embodiment.

The second articulated cap half 70 illustrated in FIG. 4, with the first articulated cap half 60, forms an articulated cap 56 which essentially fully surrounds the first and second mounting elements which are adjacent, and engage with one another, and which together form an articulated section 25 up to the area circumscribed by the opening angle 58. The outer wall 72 of the second articulated cap half 70 is designed in such a way that a first wall section 86 can be inserted along the inner side of the outer wall 62 of the first articulated cap half 60, so that an articulated cap 56, closed to the outside and which can not readily be separated, with an essentially uniform outer surface, can be obtained. The second articulated cap half 70 also has a partially truncated inner cylinder 74 which extends into the partially enclosed spaces of the first and second mounting elements. As well as an articulated cap cover 76, which closes off the retaining space 78 of the articulated cap below, the second articulated cap half 70 also has a lockable opening 80, a suction opening, and an additional locking bolt 84. With the assembly of the coupling element in accordance with the preferred embodiment, the locking pin 52 of the bridging arm 38 of the second mounting element 20 engages into the lockable opening 80. The dimensions of the lockable opening 80 mean that the room for movement for the mounting element 20, pivotally mounted in the articulated cap 56, is finally limited. In this way, the structure prevents over-straining of the flank pieces 6 and 8 caused by the coupling element being opened with too much force. It is also prevented that the mounting elements forming an articulated section 25 or 25' (not shown), when in use, deflect against one another or that individual component sections are stressed on one side. The, locking bolt 84 on the inner side of the articulated cap cover 76 also helps to limit the deflection of the first and second sealing strips and the room for movement of the articulated cap 56. The locking bolt 84 engages here into the recess 59 of the lower bridging arm 36 of the first mounting element 18. In particular, the combination of the locking bolt 52/lockable opening 80 system on the one side with the locking bolt 84/recess 59 system ensures that there is long-term, reliable relative movement of the mounting elements which are engaged together, and in particular guarantees centering of the articulated caps 60, 70 in relation to the sealing strips 2 and 4.

Figure 5:
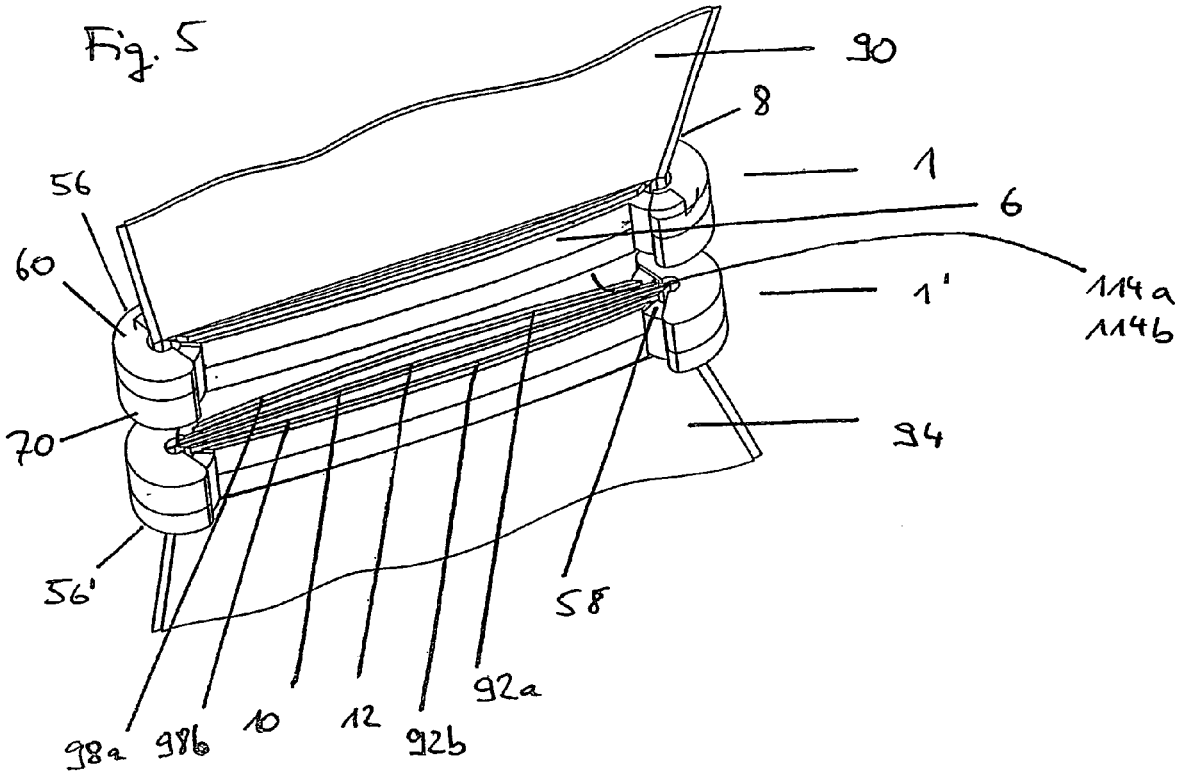
FIG. 5 shows a representation of a section of the coupling elements in accordance with the preferred embodiment.

FIG. 5 shows two coupling elements 1 and 1' in accordance with the preferred embodiment, in a side view. The first and second mounting elements of the first and second sealing strips are surrounded respectively by the first and second articulated cap halves 60 and 70, forming the articulated cap 56. The inner walls 10 and 12 of the flank pieces of the first and second sealing strips are pressed against one another in their initial state, so that the bag 90 is; fully sealed. Contributing to this, on the one hand, are the inner walls of the flank pieces 6 and 8, which in their initial state are curved, and which are positioned opposite one another during fixing of the adjacent mounting elements into the articulated caps 56, 56' on both ends of the sealing strips so as to form an essentially straight sealing slit. On the other hand, this effect is once again reinforced by the protuberant bars on the curved inner walls. In the embodiment illustrated, the edges of the flexible bag 90 are fastened to the inner walls 10 and 12 of the flank pieces 6 and 8, whereby it has proven to be particularly advantageous to extend this fastening as far as the respective opposite first and second ends of the flank pieces so that the point at which the edge of the bag changes direction essentially corresponds to the rotation point of the flank pieces when opening and closing the sealing strips. In this way, no, or very little strain is placed upon the bag during opening and closing of the coupling element, and in this way, material wear or rips, which could lead to contamination of the environment, are avoided. The edge of the flexible bag 90 is preferably attached around the lower edges of the flank pieces 6 and 8, ie. in he transition zone from the inner wall to the outer wall. This can be achieved, for example, by means of adhesion. The advantage of this type of application is that the walls of the bag lie against the protuberant bars 42*a* and 42*b*, however, if adhesive material is not used over any of the remaining sections of the inner wall, the elastic properties of the inner wall can be maintained in the long-term. Accordingly, by means of the protuberant bars 42*a* and 42'*a* and 42*b* and 42'*b* positioned together in the coupling element 1 in accordance with the preferred embodiment, a reliable seal is guaranteed (now shown). As can be seen, in particular, from the coupling element 1' in FIG. 5, the room for movement of the first and second sealing strips is pre-determined by the opening angle 58 of the articulated cap 56. If the articulated caps of a coupling element, positioned opposite one another, are pushed together, the first and second sealing strips move apart from one another, opening the bag. In order to avoid over-straining the coupling element from the start, the maximum spread of the sealing strips is defined by the opening angle 58 of the articulated caps 56. This is because as soon as the outer sides of the first and second sealing strips of a coupling element reach the edges of the articulated cap which define the opening angle 58, further opening is no longer possible without causing damage. The locking pin 52 and lockable opening 80 system and the recess 59 and locking bolt 84 system also contribute to limiting the opening angle.

In the same way as a flexible bag 90 is fastened with the coupling element 1, a flexible decanting tube 94, for example, can also be attached to the coupling element 1'. The coupling elements 1 and 1' are essentially of identical dimensions, and when in the state whereby they are coupled to one another, form a docking device 96 in accordance with the preferred embodiment. In a preferred embodiment, docking, isolated from the environment, is achieved by applying or incorporating grooves 92*a*, 92*b* along the upper edges 98*a* and 98*b* and on the upper sides 13, 15 of the flank pieces 6, 8 of the first and second sealing strips 2 and 4 of the second coupling element 1', which, can preferably be introduced, to fit exactly, into corresponding clip elements 11 4*a* and 11 4*b* provided in the lower sides of the flank pieces 6, 8 of the first and second sealing strips 2 and 4 of the coupling element 1.

Figure 6:
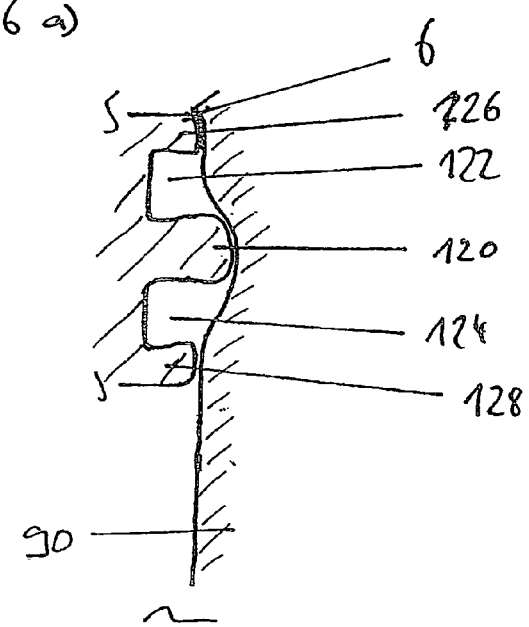
FIG. 6*a*) shows a cross-section view of a preferred flank piece of a coupling element in accordance with the preferred embodiment.
FIG. 6*b*) shows a perspective partial view of a flank piece in accordance with FIG. 6*a*)

FIG. 6*a*) shows a cross-sectional representation of a particularly preferred flank piece 6 of a coupling element 1 in accordance with the preferred embodiment. In this embodiment, an essentially elastic, protuberant bar 120 is provided along a central longitudinal axis of the flank piece. On both sides of this central elastic bar 120, recesses 122 and 124 extend, into which side edge sections 126 and 128, raised on both sides, then attach. Because the edge of a flexible bag 90 is only fastened on one upper side edge 126, eg. by means of an adhesive, it is possible to prevent the bar 120, which brings about the seal by means of the coupling element, losing its elastic properties, eg. due to hardening caused by the adhesive. Moreover, because the edge of the flexible bag is only connected to the inner wall of the flank piece at one point, the edge of the bag is given the greatest possible freedom of movement, whereby tensions, splits or material wear of the bag can be reduced. The increased freedom of movement of the edge of the bag in connection with the recesses 122 and 124 also helps the coupling element itself to form a seal again, isolated from the environment, if there are bulk material remains in the area between adjacent flank pieces of the coupling element. Because the bag is now fixed to a point, these remains can be pushed into the recesses and do not effect an insulated seal of the coupling element via the protuberant elastic bar 120. A particularly preferred coupling element here is one which has a first and second sealing strip with flank pieces, as shown in FIG. 6*a*).

Figure 6B:
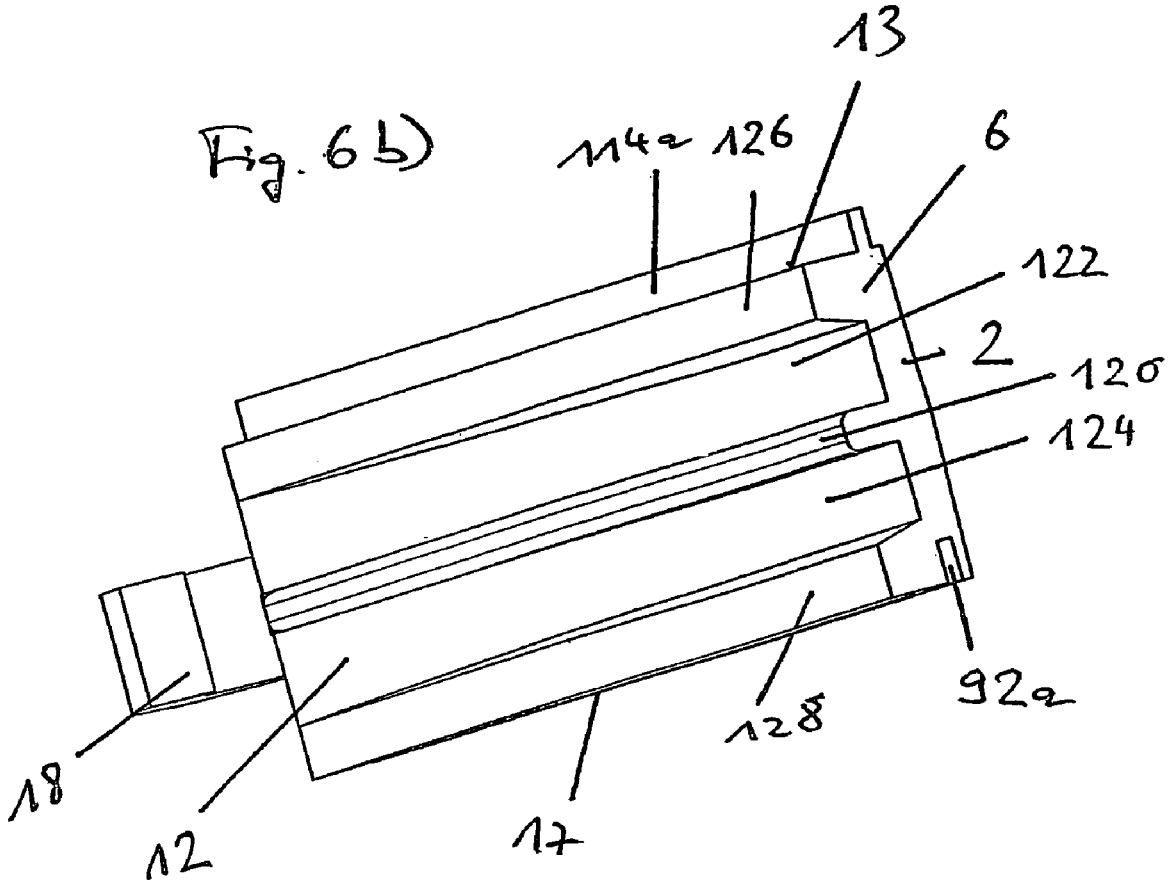

FIG. 6*b*) reproduces a perspective partial view of a flank piece in accordance with FIG. 6*a*), without, however, showing the flexible bag 90. In FIG. 6*b*), one can see the recesses 122 and 126 which extend over the inner sides of the flank piece 6, the raised side edges 126 and 128, and a centrally extending elastic bar 120. Moreover, FIG. 6*b*) shows a clip element 114*a* on the upper side and the upper edge of the flank piece 6 and a groove 92*a* along the lower side 17 of the flank piece 6 of the sealing strip 2. With the help of this type of groove and clip element, it is possible to provide docking, isolated from the environment, with an adjacent coupling element, which is correspondingly also provided with a groove and a clip element.

Figure 7:
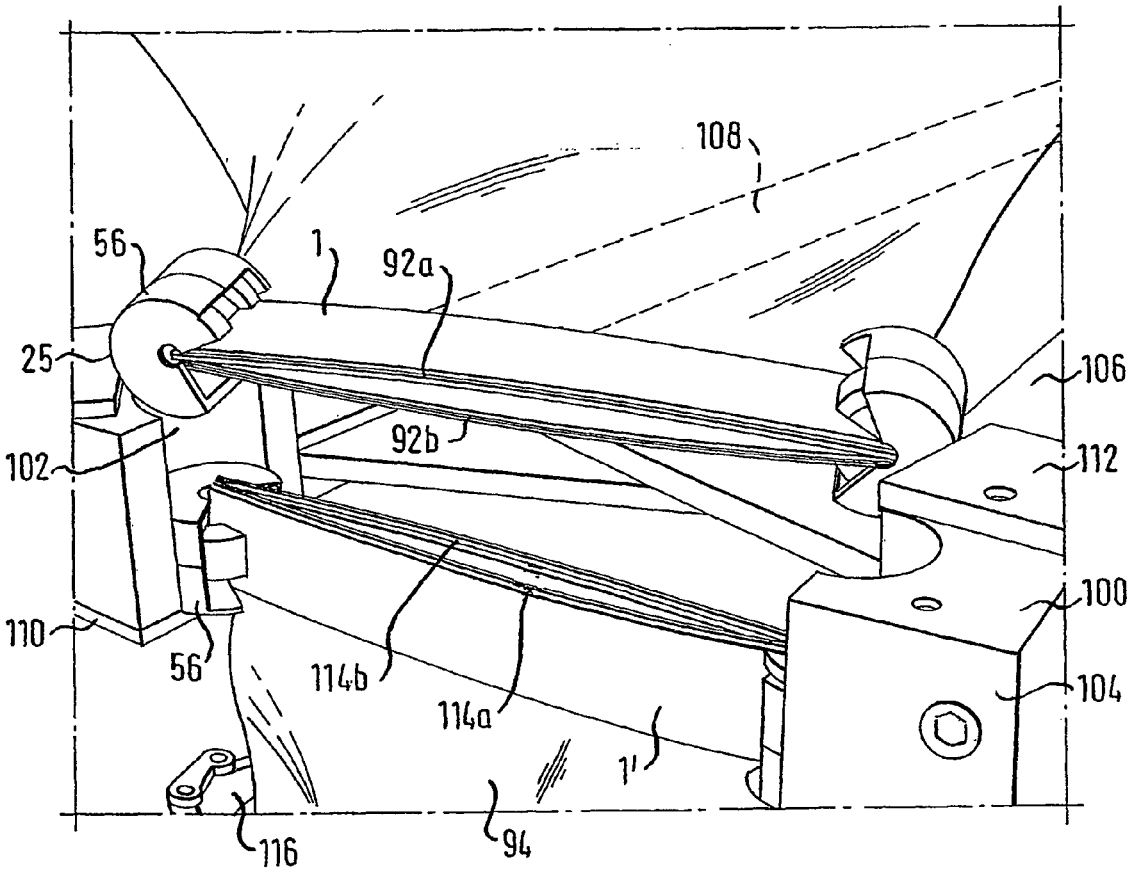
FIG. 7 shows a perspective view of a part of a holding device in accordance with the preferred embodiment.
Figure 8:
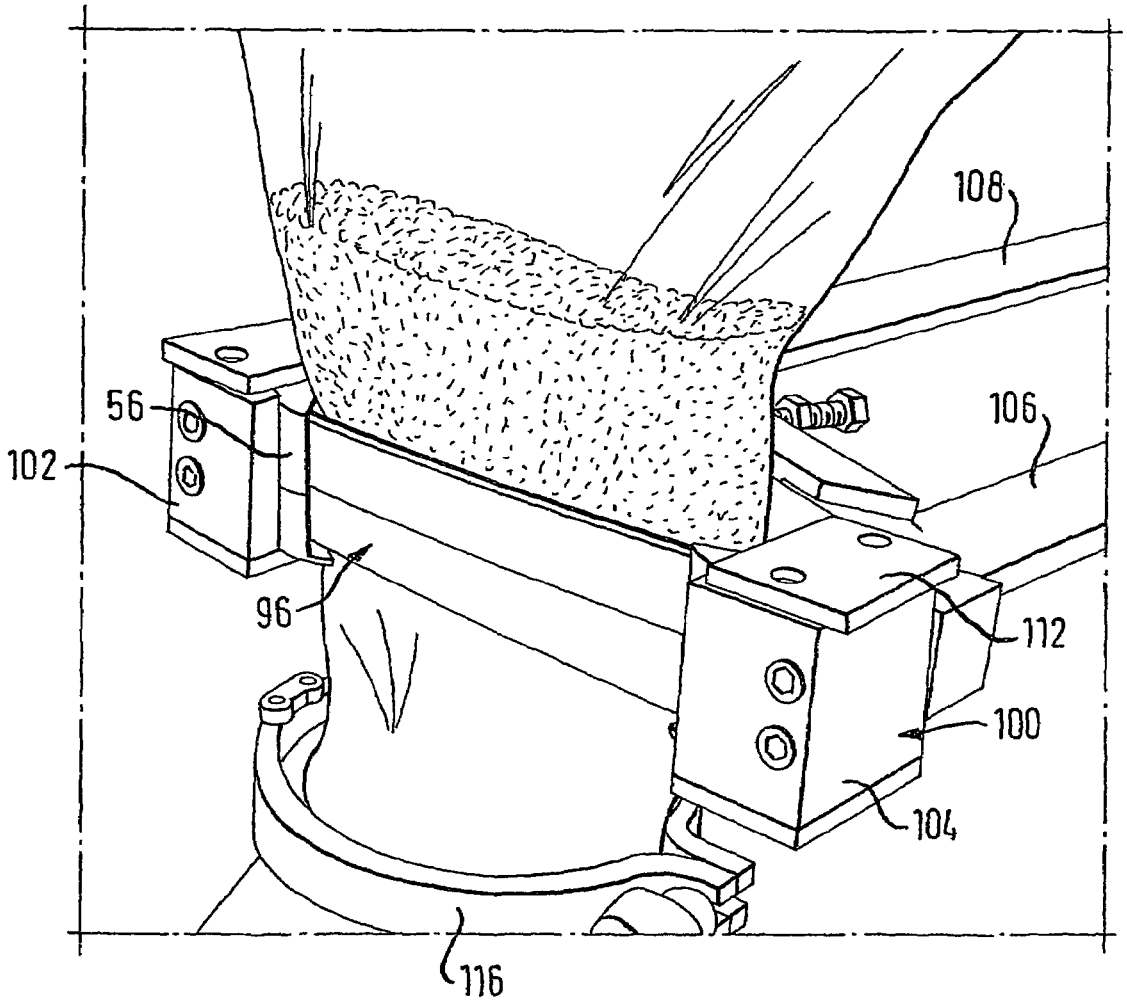
FIG. 8 shows a perspective representation of a holding device in accordance with the preferred embodiment including a docking device in accordance with the preferred embodiment.
Figure 9:
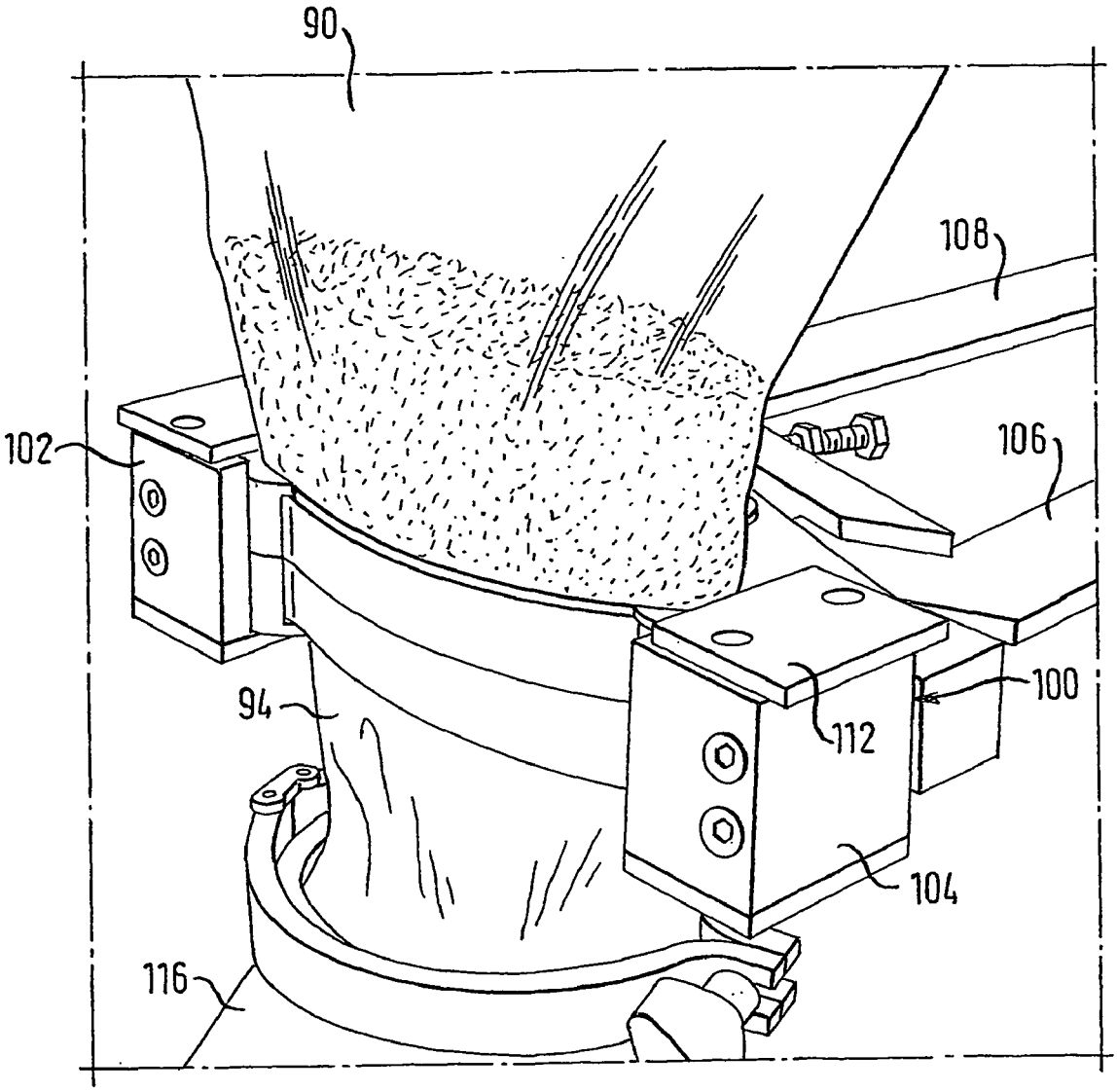
FIG. 9 shows a perspective view of a holding device in accordance with the invention with a docking device in accordance with the preferred embodiment.

FIG. 7 shows a holding device 100 in accordance with the preferred embodiment, with a first retainer unit 102 and a second retainer unit 104, as well as lever arms 106 and 108. The retainer units 102 and 104 are designed in such a way that they can retain the articulated caps 56, 56' of the coupling elements 1 and 1', at least partially flush. Preferably, at least sections of the retainer unit and the articulated cap act as negative and positive fits. The coupling element 1' is already located in the holding device 100, whereby the decanting tube 94 is connected to a container 116 which is to be filled. As already shown in FIG. 5, the coupling element 1 has clip elements 114*a* and 114*b* on the upper side of the sealing strips and flank pieces. Correspondingly, the coupling element 1 has grooves 92*a* and 92*b* to retain the clip elements of the coupling element 1' on the lower sides of the sealing strips and flank pieces. The coupling element 1' is held in the retainer units 102 and 104 on its lower side by means of floor plates 110. After introducing the coupling element 1 into the holding device 100, the upper holding plates 112 can be conveyed over the upper sides of the articulated caps 56 and fixed, eg. using screws, as shown in FIG. 8. Advantageously, the retainer units 102 and 104 have dimensions such that by fastening or screwing on the upper holding plate 112, the clips 114*a*, 114*b* and grooves 92*a*, 92*b* are respectively fully linked together. In this way, a docking device 96, totally isolated from the environment, is obtained, with which any bulk goods, as eg. shown in FIG. 9, can be transferred into fixed or transportable containers 116. In addition, the lever arms 106 and 108 are manipulated in such a way that the first and second retainer units 102 and 104 are moved towards one another. In this way, the first and second sealing strips of the first and second coupling elements move away from one another uniformly, while opening both the flexible bag 90 and the flexible decanting tube 94. When both the flexible bag 90 and the flexible decanting tube 94 have respectively been conveyed to the outer edge of the flank pieces or sealing strips, these edges attach to one another as the coupling elements are coupled to form a docking unit, so that, when decanting the bulk material, not a single component of the docking device in accordance with the preferred embodiment comes into contact with this bulk material. After having removed the bag and introduced a new bag, the docking device in accordance with the preferred embodiment can be used again, free from contamination, without there being any necessity for additional cleaning measures. Removal of the docking device in accordance with the preferred embodiment from the holding device 100 is just as easy as its installation. After having removed the upper holding plate 112, the coupling elements 1 and I' can be readily separated from one another, respectively in sealed state, so that even after successful filling or decanting, there is no risk of contamination of the environment or of the products which have been decanted.

Figure 10:
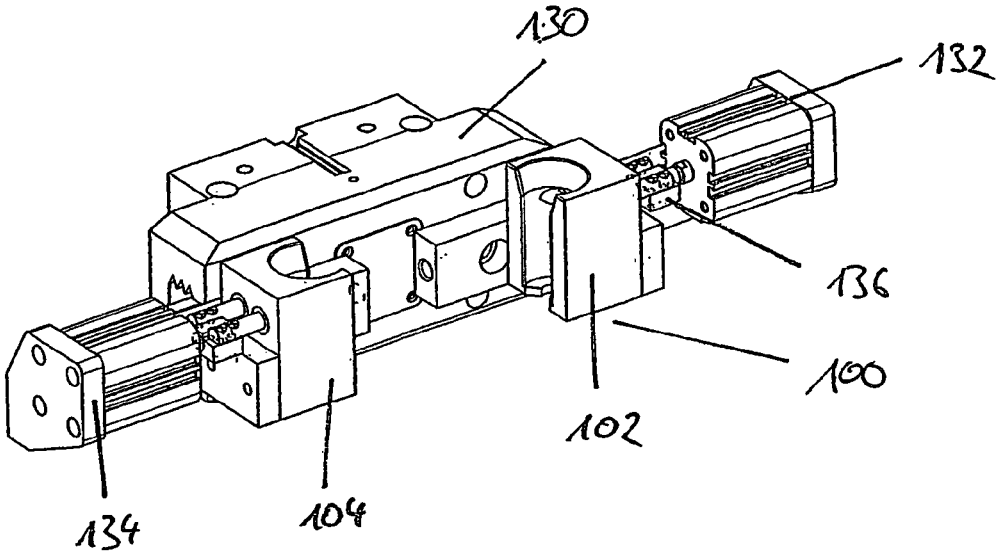
FIG. 10*a*) shows a perspective view of an alternative holding device in accordance with the preferred embodiment.
FIG. 10*b*) shows a section of the view in accordance with FIG. 10*a*).
Figure 10:
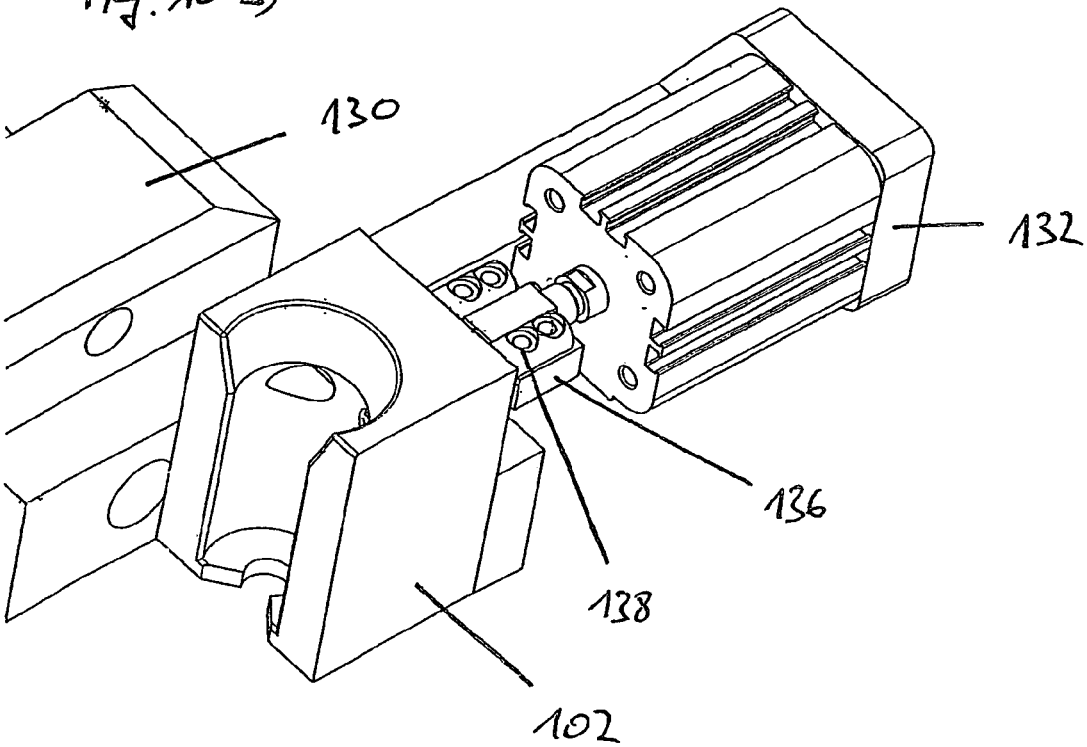

FIG. 10*a*) shows a pneumatically driven holding device 100 with a first retainer unit 102 and a second retainer unit 104 for retaining a coupling element 1 in accordance with the preferred embodiment or a docking device 96 in accordance with the preferred embodiment. The pneumatically driven holding device 100 has a pneumatic actuating drive 130 with which the retainer units 102 and 104 can be moved towards one another and away from one another by means of the pnemnatic cylinders 132 and 134, at the same time opening or closing the docking device. With this type of pneumatic holding device or opening unit, the extent of the opening, and so also the decanting speed, can be adjusted very accurately. It is also an advantage that with coupling elements with very bend-resistant sealing strips which, when under preliminary tension, as described above, guarantee a high level of isolation from the environment, they still allow opening and closing to be implemented smoothly. In this way, the pneumatic cylinders 132, 134 can move the retainer units 102 and 104 towards or away from one another by means of a releasable coupling 136. As also shown in FIG. 10*b*), the coupling 136 can be locked in a retainer unit by means of two, for example pneumatically controlled, pins. With the help of the pneumatically driven holding device 100, it is very easy to automate a filling or decanting process by using the coupling elements and docking devices in accordance with the invention.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim:

1. A coupling element for decanting, filling, or emptying of containers, comprising:

a first sealing strip comprising a flank piece which is elastic at least in sections, with an inner side, an outer side, an upper side, and a lower side, a first mounting element on a first end of the flank piece and which defines a first inner space for retaining a first axis, and a second mounting element on a second opposite end of the flank piece and which defines a second inner space for retaining a second axis;

a second sealing strip comprising a flank piece which is elastic at least in sections, with an inner side, an outer side, an upper side, and a lower side, a first mounting element on a first end of the flank piece and which defines a first inner space for retaining the second axis, and a second mounting element on a second opposite end of the flank piece and which defines a second inner space for retaining the first axis;

said inner sides of said flank pieces of said first and second sealing strips being attachable to one another to form a seal, at least in sections, the first mounting element of said first sealing strip and the second mounting element of the second sealing strip being positioned adjacent one another to form a first articulated section, and the second mounting element of the first sealing strip and the first mounting element of the second sealing strip being positioned adjacent to one another to form a second articulated section;

a first articulated cap forming a pivot bearing and positioned at least partially over said first articulated section, and a second articulated cap forming a pivot bearing and is positioned at least partially over said second articulated section; and said first axis being retained in said first inner space of said first mounting element for pivotable mounting of said first articulated section, and said second axis being retained in said second inner space of said second mounting element for pivotable mounting of said second articulated section.

2. A coupling element of claim 1 wherein said first and second mounting elements of said first sealing strip and said first and second mounting elements of said second sealing strip are rounded.

3. A coupling element of claim 2 wherein said first and second mounting elements of said first sealing strip and first and second mounting elements of said second sealing strip comprise a radial outer circumference.

4. A coupling element of claim 2 wherein the first and second mounting elements of the first and second sealing strips are at least partially in the form of an annulus.

5. A coupling element of claim 4 wherein the first and second mounting elements of the first and second sealing strips are attachable to an outer side of the first and second ends of the flank pieces of the first and second sealing strips.

6. A coupling element according to claim 4 wherein the first and second mounting elements do not extend to an inner side of the flank pieces of the first and second sealing strips.

7. A coupling element according to claim 1 wherein the first and second articulated caps have inner dimensions substantially corresponding to outer dimensions of the adjacent first and second mounting elements of the first and second sealing strips, and the adjacent second and first mounting elements of the first and second sealing strips so that when the inner sides of the flank pieces of the first and second sealing strips are positioned together the first and second articulated caps respectively enclose the respective first and second mounting elements.

8. A coupling element according to claim 1 wherein the first and second articulated caps each comprise an articulated cap cover wherein an articulated axis is introduceable into said first inner space and into said second inner space.

9. A coupling element according to claim 1 wherein the first end of the flank piece of the first sealing element and the second end of the flank piece of the second sealing element extend into said first inner space, and the second end of the flank piece of the first sealing element and the first end of the flank piece of the second sealing element extend into said second inner space.

10. A coupling element according to claim 1 wherein the first mounting element of the first and second sealing strips comprises at least one annular section, and the second mounting element of the first and second sealing strips comprises at least two annular sections spaced apart from one another, the annular section of the first mounting element fitting between the two annular sections so as to form said first articulated section, and wherein the annular section of the second mounting element fits between two annular sections of the first mounting element to form said second articulated section.

11. A coupling element according to claim 1 wherein the first and second mounting elements of the first and second sealing strips form a substantially uniform cylindrical outer surface.

12. A coupling element according to claim 1 wherein said inner side of said flank piece of said first sealing strip and the inner side of said flank piece of said second sealing strip are curved.

13. A coupling element according to claim 1 wherein with the inner sides of the flank pieces are flush, and at least the outer side of each flank piece having an outer curve.

14. A coupling element according to claim 1 wherein the inner side of at least one of the two flank pieces is profiled.

15. A coupling element according to claim 1 wherein at least one elastic protuberant bar and at least one recessed groove are provided on the inner side of the flank piece of each of the first and second sealing strips substantially parallel to a longitudinal axis of each flank piece.

16. A coupling element according to claim 15 wherein at least one protuberant bar is provided at least at one longitudinal edge of each flank piece.

17. A coupling element according to claim 15 wherein the protuberant bar is substantially in the form of a circle section.

18. A coupling element according to claim 1 wherein the inner side of the flank pieces have at least one protruding bar and at least one recessed groove between the protruding bar and an upper edge of the flank piece, and at least one recessed groove between the protruding bar and a lower edge of the inner wall of the flank piece.

19. A coupling element according to claim 18 wherein the protruding bar protrudes more strongly from the inner wall than at the lower and upper edges.

20. A coupling element according to claim 1 wherein each of said flank pieces is designed such that each of the flank pieces is designed such that an end of the flexible container is positioned between the flank pieces such that an end of the flexible container is in line with upper or lower edges of each flank piece.

21. A coupling element according to claim 20 wherein the first and second flank pieces are designed to receive therebetween a tube such that an edge of the tube is aligned with upper or lower edges of the flank pieces.

22. A coupling element according to claim 20 wherein each flank piece at the upper or lower side has a groove or a clip thereat.

23. A coupling element according to claim 22 wherein each flank piece has at one of said upper or lower side a groove and at the other lower or upper side a clip.

24. A coupling element according to claim 1 wherein a first and second sealing strip at the upper or lower sides is provided with an adhesive.

25. A coupling element according to claim 1 wherein the first and second sealing strips substantially correspond to one another with respect to shape and size.

26. A coupling element according to claim 1 wherein at the inner side of each of the flank pieces an elastomer or thermoplastic elastomer segment is provided.

27. A coupling element according to claim 1 wherein the first and second articulated caps each comprise first and second articulated cap halves.

28. A coupling element according claim 27 wherein the articulated cap halves have a lockable opening and a rounded outer surface for retaining a locking pin of a mounting element or locking bolt.

29. A coupling element according to claim 1 wherein the first and second articulated caps have a pre-specified open section which determines an opening angle of the first and second sealing strips in an area of the first and second articulated sections.

30. A coupling element according to claim 1 wherein the mounting elements comprise thermoplastic polymers along rounded outer surfaces.

31. A coupling element according claim 1 wherein at least one locking unit for fixing of a position of the first and second sealing strips is provided.

32. A coupling element according to claim 1 wherein at least one removable device is provided for the use with a flexible container retained by the coupling element.

33. A coupling element according to claim 32 wherein the removable device is attachable to the flexible container.

34. A coupling element according to claim 1 wherein the decanting, filling, or emptying of the containers is isolated from the environment.

35. A docking system for filling, decanting, or emptying bulk goods for fluids to or from containers, comprising:

first and second coupling elements which are attachable to one another, each coupling element comprising a first sealing strip comprising a flank piece which is elastic at least in sections, with an inner side, an outer side, an upper side, and a lower side, a first mounting element on a first end of the flank piece and which defines a first inner space for retaining a first axis, and a second mounting element on a second opposite end of the flank piece and which defines a second inner space for retaining a second axis;

a second sealing strip comprising a flank piece which is elastic at least in sections, with an inner side, an outer side, an upper side, and a lower side, a first mounting element on a first end of the flank piece and which defines a first inner space for retaining the second axis, and a second mounting element on a second opposite end of the flank piece and which defines a second inner space for retaining the first axis;

said inner sides of said flank pieces of said first and second sealing strips being attachable to one another to form a seal, at least in sections, the first mounting element of said first sealing strip and the second mounting element of the second sealing strip being positioned adjacent one another to form a first articulated section, and the second mounting element of the first sealing strip and the first mounting element of the second sealing strip being positioned adjacent to one another to form a second articulated section;

a first articulated cap forming a pivot bearing and positioned at least partially over said first articulated section, and a second articulated cap forming a pivot bearing and positioned at least partially over said second articulated section; and said first axis being retained in said first inner space of said first mounting element for pivotable mounting of said first articulated section, and said second axis being retained in said second inner space of said second mounting element for pivotable mounting of said second articulated section.

36. A docking system of claim 35 wherein at least one of the coupling elements is attachable to a flexible container.

37. A docking system of claim 35 wherein at least one of the coupling elements is attachable to a flexible tubular piece.

38. A docking system of claim 35 wherein a holding device is provided from manipulating the first and second coupling elements, said holding device comprising:

a first unit for retaining or locking the first articulated section of the first coupling element, a second retainer unit for retaining or locking the second articulated section opposite the first articulated section of the first coupling element; and a positioning mechanism designed such that it moves the first unit and the second unit towards and away from one another for opening and closing.

39. A docking system of claim 38 wherein the holding device comprises at least one axis for retaining a first or second mounting element of the first or second sealing strip.

40. A docking system of claim 38 wherein the holding device comprises the first or second unit having a lower or upper locating mechanism.

41. A docking system of claim 38 wherein the holding device is designed such that a distance moved by the first and second units towards or away from one another is limited.

42. A docking system of claim 38 wherein at least one suction device is provided which works in conjunction with the holding device.

43. A docking system of claim 38 wherein the holding device comprises at least one positioning mechanism.

44. A connection system for filling with or decanting bulk goods or fluids, comprising:

a substantially tubular structure with at least first and second openings;

at least edge sections of the first and second openings being flexible;

a first coupling element attachable to the first opening of the tubular structure;

a second coupling element attachable to the second opening of the tubular structure; and the first and second coupling elements each comprising a first sealing strip comprising a flank piece which is elastic at least in sections, with an inner side, an outer side, an upper side, and a lower side, a first mounting element on a first end of the flank piece and which defines a first inner space for retaining a first axis, and a second mounting element on a second opposite end of the flank piece and which defines a second inner space for retaining a second axis;

a second sealing strip comprising a flank piece which is elastic at least in sections, with an inner side, an outer side, an upper side, and a lower side, a first mounting element on a first end of the flank piece and which defines a first inner space for retaining the second axis, and a second mounting element on a second opposite end of the flank piece and which defines a second inner space for retaining the first axis;

said inner sides of said flank pieces of said first and second sealing strips being attachable to one another to form a seal, at least in sections, the first mounting element of said first sealing strip and the second mounting element of the second sealing strip being positioned adjacent one another to form a first articulated section, and the second mounting element of the first sealing strip and the first mounting element of the second sealing strip being positioned adjacent to one another to form a second articulated section;

a first articulated cap forming a pivot bearing and positioned at least partially over said first articulated section, and a second articulated cap forming a pivot bearing and positioned at least partially over said second articulated section; and said first axis being retained in said first inner space of said first mounting element for pivotable mounting of said first articulated section, and said second axis being retained in said second inner space of said second mounting element for pivotable mounting of said second articulated section.

* * * * *